US008826841B2

(12) United States Patent
Moreau

(10) Patent No.: US 8,826,841 B2
(45) Date of Patent: Sep. 9, 2014

(54) DEVICE FOR GRIPPING AND ADJUSTING THE TENSION OF AN ELONGATE ELEMENT SUCH AS A CABLE, ROPE OR THE LIKE

(76) Inventor: Ludwig Moreau, Juan les Pins (FR)

( * ) Notice: Subject to any disclaimer, the term of this patent is extended or adjusted under 35 U.S.C. 154(b) by 98 days.

(21) Appl. No.: 13/700,404

(22) PCT Filed: May 25, 2011

(86) PCT No.: PCT/EP2011/058527

§ 371 (c)(1),
(2), (4) Date: Nov. 27, 2012

(87) PCT Pub. No.: WO2011/147858

PCT Pub. Date: Dec. 1, 2011

(65) Prior Publication Data

US 2013/0074756 A1 Mar. 28, 2013

(30) Foreign Application Priority Data

May 27, 2010 (FR) ..... 10 54102

(51) Int. Cl.

| | |
|---|---|
| ***B63B 21/04*** | (2006.01) |
| ***B63B 17/00*** | (2006.01) |
| ***B66D 3/00*** | (2006.01) |
| ***B65H 59/22*** | (2006.01) |

(52) U.S. Cl.

CPC ..... *B65H 59/22* (2013.01); *B63B 17/00* (2013.01); *B66D 3/006* (2013.01)

USPC ..... 114/218; 114/293

(58) Field of Classification Search

USPC ..... 114/293, 218

IPC ..... B63B 21/08,21/50

See application file for complete search history.

(56) References Cited

U.S. PATENT DOCUMENTS

| | | | | |
|---|---|---|---|---|
| 3,096,075 | A * | 7/1963 | Brown | 254/29 R |
| 3,748,702 | A * | 7/1973 | Brown | 188/67 |
| 4,093,042 | A * | 6/1978 | Pradon | 188/67 |
| 4,446,807 | A * | 5/1984 | Johnson et al. | 114/230.23 |
| 4,448,393 | A * | 5/1984 | Habegger et al. | 254/264 |
| 4,456,226 | A * | 6/1984 | Stumpmeier | 254/264 |

(Continued)

FOREIGN PATENT DOCUMENTS

WO 2007015642 2/2007

OTHER PUBLICATIONS

International Search Report dated Sep. 7, 2011 for International Application No. PCT/EP2011/058527, filed May 25, 2011, Applicant, Ludwig Moreau (4 pages).

(Continued)

*Primary Examiner* — Stephen Avila

(74) *Attorney, Agent, or Firm* — McCracken & Frank LLC

(57) ABSTRACT

The present invention concerns to a device for gripping and adjusting the tension in an elongated component. The device is characterized in that front tightening assembly (101) is mobile relative to rear body (10) and includes means (9) for joining to jaws (3), these means remaining active after said jaws (3) have gripped the component so that the movement of said jaws (3) results in movement of said joined assembly (101) which then applies forward traction on elongated component (E). Applications found in the handling of elongated objects such as cables, ropes or similar parts.

14 Claims, 4 Drawing Sheets

(56) References Cited

U.S. PATENT DOCUMENTS

Figure 1:
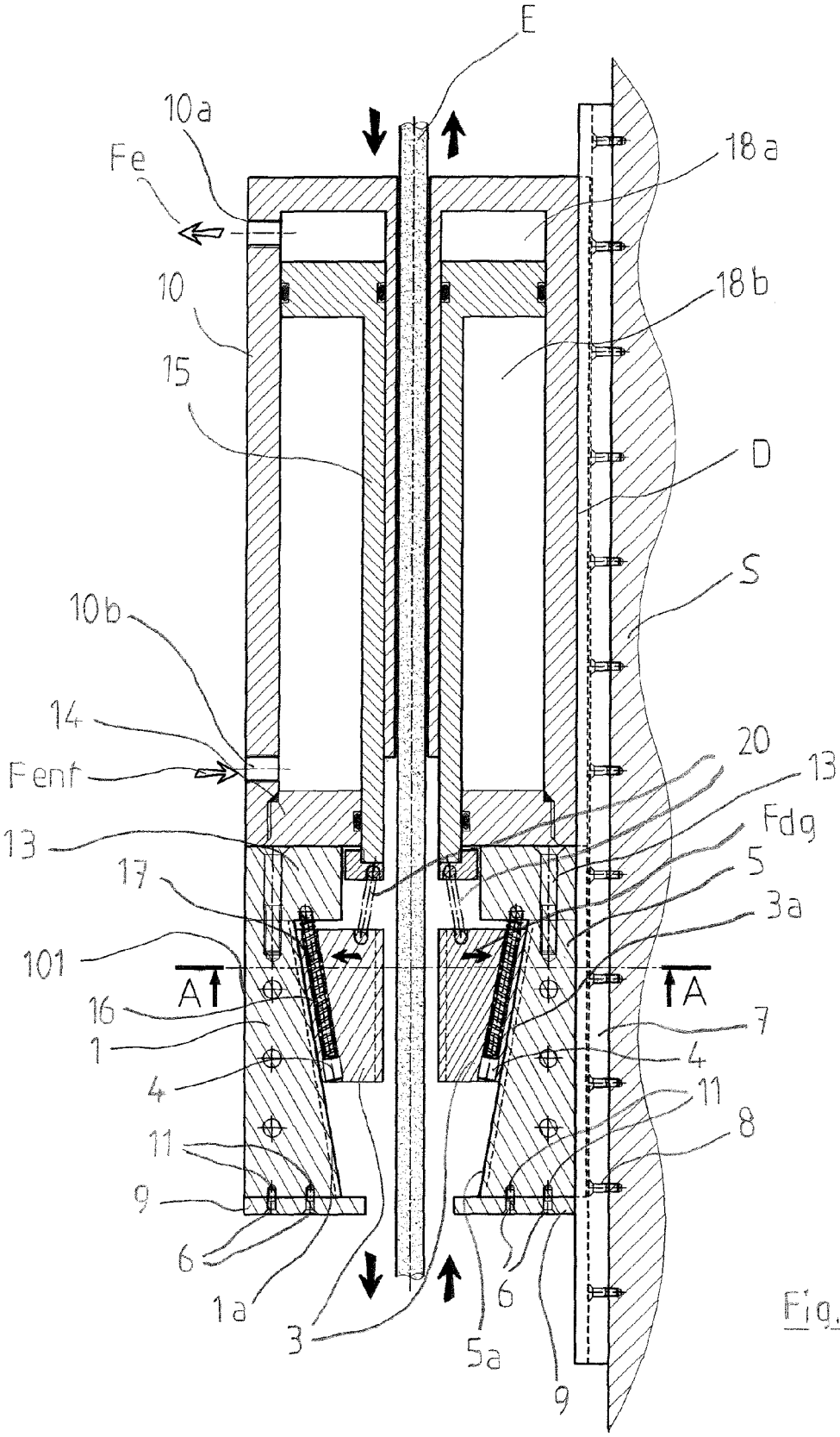

| | | | | |
|---|---|---|---|---|
| 4,615,509 | A | | 10/1986 | Biass |
| 4,878,452 | A | * | 11/1989 | Regan et al. ..... 114/293 |
| 5,392,496 | A | | 2/1995 | Johnson |
| 6,283,451 | B1 | | 9/2001 | Stankus et al. |

OTHER PUBLICATIONS

European Patent Office Written Opinion for International Application No. PCT/EP2011/058527, filed May 25, 2011, Applicant, Ludwig Moreau (5 pages).

* cited by examiner

DEVICE FOR GRIPPING AND ADJUSTING THE TENSION OF AN ELONGATE ELEMENT SUCH AS A CABLE, ROPE OR THE LIKE

TECHNICAL FIELD

This invention concerns a device for gripping and adjusting the tension of an elongated component, type cable, rope or similar.

More particularly, the present invention relates to a device for gripping and adjusting the tension of an elongated component using the same device as for gripping which applies a tractive force on the elongated component enabling it to be tightened, the tension on the elongated component also being adjustable to a certain extent while retaining its grip on this component.

BACKGROUND

There are many known devices for gripping used to handle cable, rope or similar components.

Gripping generally involves the use of jaws or a bit which closes on the elongated object. The use of at least one means for actuating the jaws or the bit, in particular at least one cylinder, is also known.

Therefore, such a gripping device according to the state-of-the-art is longitudinally traversed in its middle part by the elongated component and in general has in its length a rear body extended by a front tightening assembly acting transversely on the extended part of the device using jaws around at least part of the said component. These jaws are arranged inside the said front assembly while retaining their longitudinal mobility in the said front assembly under the action of at least one actuating means. The front assembly has at least one jaw guidance system closing the jaws and gripping the said component inside the said assembly, the distance between the jaws decreasing as they move towards the front in the said assembly.

For example, document GB-A-190928294 reveals a cable or rope blocking system using at least one cylinder, and an inclined plane bringing together or moving apart the two gripping parts, each one coasting with a cylinder.

The aim of the present invention is to simplify existing devices for gripping an elongated component while also enabling them to apply tension to the elongated component including the possibility of adjusting this tension.

A same device which grips an elongated component and applies tension to the said component while allowing this tension to be adjusted is neither described nor suggested by the state-of-the-art.

SUMMARY

To achieve this aim, the invention proposes a device for gripping and adjusting the tension of an elongated component, the said device being penetrated longitudinally in its middle by the said elongated component and comprising lengthwise a rear body through which the said component is inserted, extended by a front tightening assembly, also used to allow the said component to emerge from the device and applying force transversally on the said elongated component by jaws enclosing, at least partially, the said component and arranged inside the said front assembly, the said jaws being longitudinally mobile inside the said front assembly under the force of at least one actuating means the said front assembly having at least a one-jaw guiding system moving the jaws closer together in order to grip the said component inside the said assembly, the distance between the jaws decreasing as they move towards the front, characterised in that the front tightening assembly is mobile relative to the rear body and includes at least one means for joining it to the jaws, such means becoming active after the said jaws are placed in a gripping position, movement of the said jaws also moving the said joined assembly which then applies a tractive force towards the front of the elongated component.

The technical effect obtained by the present invention is to enable, in particular using a same cylinder or using more than one cylinder in simultaneous and synchronized operation, two successive actions, that is to say gripping followed by adjustable tensioning of the elongated component. The device according to the present invention has the advantage of being much less complex than the combination of state-of-the-art devices performing gripping with a device for adjusting the tension of the component, in particular involving fewer cylinders. The device according to the present invention has therefore the advantage of enabling a single device to adjust the tension of an elongated object while retaining its grip, this without requiring any special control means for executing these two actions.

This is achieved by sliding the front tightening part relative to the rear body of the device in accordance with the invention, this sliding motion, after gripping a rope, a cable or a technical equivalent, being used to adjust its tension while retaining its grip. This is carried out by varying the tractive force applied to the said component.

Advantageously, the joining means consist of a stop arranged in the front part of the front assembly preventing forward movement of the jaws relative to the said assembly. In fact, the stop represents a simple embodiment of the joining means.

Advantageously, the stop takes the form of a stop plate arranged removably at the front part of the front tightening assembly. The removable nature and the shape of this retaining plate are advantageous in that they allow easy replacement of the plate in order to adapt it, if necessary, to the different forms of the jaws used or make good its wear.

Advantageously, the front tightening assembly includes two bases arranged symmetrically relative to its longitude axis, each one of the bases being associated with one jaw and at least one base plate with an internal wall forming a ramp so that one jaw can slide on it while being inclined towards the longitudinal axis of the front assembly in the direction of the said assembly, the said wall being part of the jaw guiding system. Thus, progressive gripping of the elongated component occurs. In the case of two bases, each one with an inclined wall, the gripping force is advantageously distributed uniformly around the elongated component.

Advantageously, the guiding system has sliding means and/or lateral retaining means in the form of a dovetail, a rail or a track coasting with bearing rollers or balls, a solid film or a lubricant. Indeed, it is desirable that there are good sliding conditions between the jaw and the corresponding base and if appropriate a limit on undesirable movements of the jaw laterally relative to the front tightening assembly.

Advantageously, return means are provided between each jaw and the rear part of the front tightening assembly, the first end of the return means coacting with the said rear part and the second end being joined on the jaws, the return means returning their associated jaw towards the rear and therefore in a position that releases the elongated component from the jaws. This constitutes simple, effective and economic means for returning the jaws to their start position.

Preferably, each jaw has at least one cavity receiving, at least partially, the return means, for example in the form of a helicoidal spring, this cavity extending roughly parallel to the inner wall of the associated base, the second end of the spring being joined to the bottom of the cavity, a retaining component being positioned inside the spring, one end of this retaining component being joined to the rear part of the front assembly in common with the first end of the spring. In this embodiment, the return force is roughly parallel to the inner wall of the associated base allowing the sliding motion of the jaw.

Advantageously, the actuating means consist in at least one cylinder, the cylinder body comprising the rear body of the device and the cylinder rod being connected to the rear part of at least one jaw. This creates a compact device with cylinder body incorporated in the rear body of the device, which also protects the cylinder.

Advantageously, the cylinder is a double-acting cylinder comprising a first chamber with a hydraulic liquid intake or discharge port, the intake of liquid into this chamber driving the rod out of the cylinder body and a second chamber with an intake or discharge port, the intake of fluid into this chamber driving retraction of the rod inside the cylinder body. This is a preferred embodiment of the invention which allows effective adjustment of the elongated component tension, either in the form of a tractive force applied on the component or relaxation of the tension of this component.

In a preferred arrangement, a coupling rod couples the cylinder rod and at least one jaw, this coupling rod being articulated respectively with the cylinder rod and the said jaws. This arrangement makes it possible to adapt the said coupling so that it follows the movement of the jaw(s) on the internal sloping wall of the associated base.

Preferably, a single cylinder actuates the jaws. This is an advantageous simplification of the device according to the invention using minimum means to move the jaws.

Advantageously, the device is intended to receive an elongated component such as a rope, cable or similar, each internal surface of the jaws opposite of this elongated component having an imprint adapted to the elongated component in order to coact with the said component when gripping it. The imprint adapts the internal surface of the jaws to the type of elongated component to be gripped and to adjust the tension.

The invention also concerns a support structure characterised in that it is equipped with such a device for gripping and adjusting the tension of an elongated component, the said device being fastened to the support structure by a base, the front tightening assembly of the said device having freedom to slide relative to the base in the longitudinal direction of the device, means for sliding and/or lateral retention being provided between the front assembly and the base. Thus, the rear body of the device is fixed to the support structure and the front assembly can only move in the longitudinal direction of the device due to its fixing to one degree of is freedom relative to the fixing base.

Advantageously, the support structure is a ship, the elongated element being a rope of an item of equipment present on the said ship.

BRIEF DESCTRIPTION OF THE DRAWINGS

Figure 2:
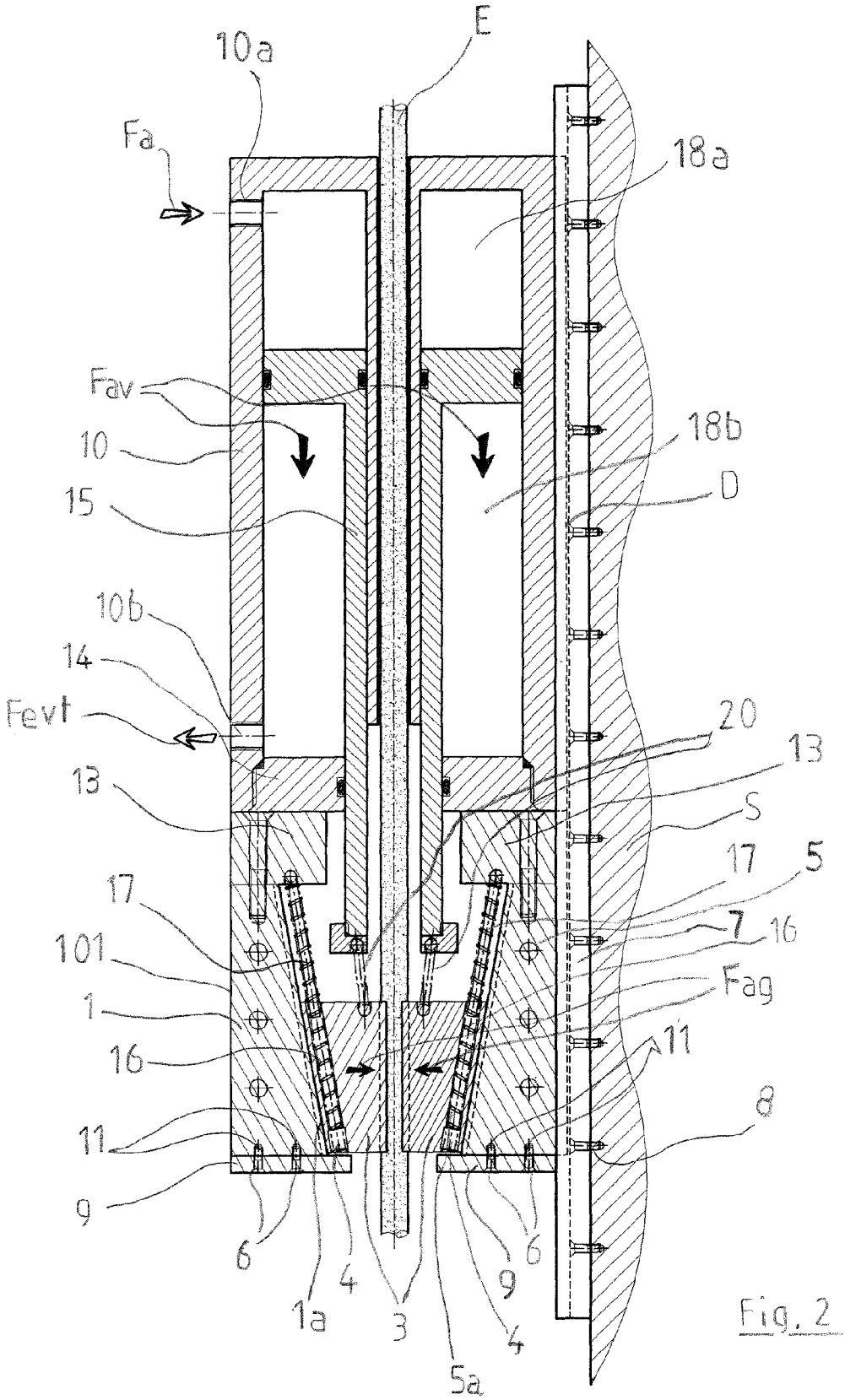
Figure 3:
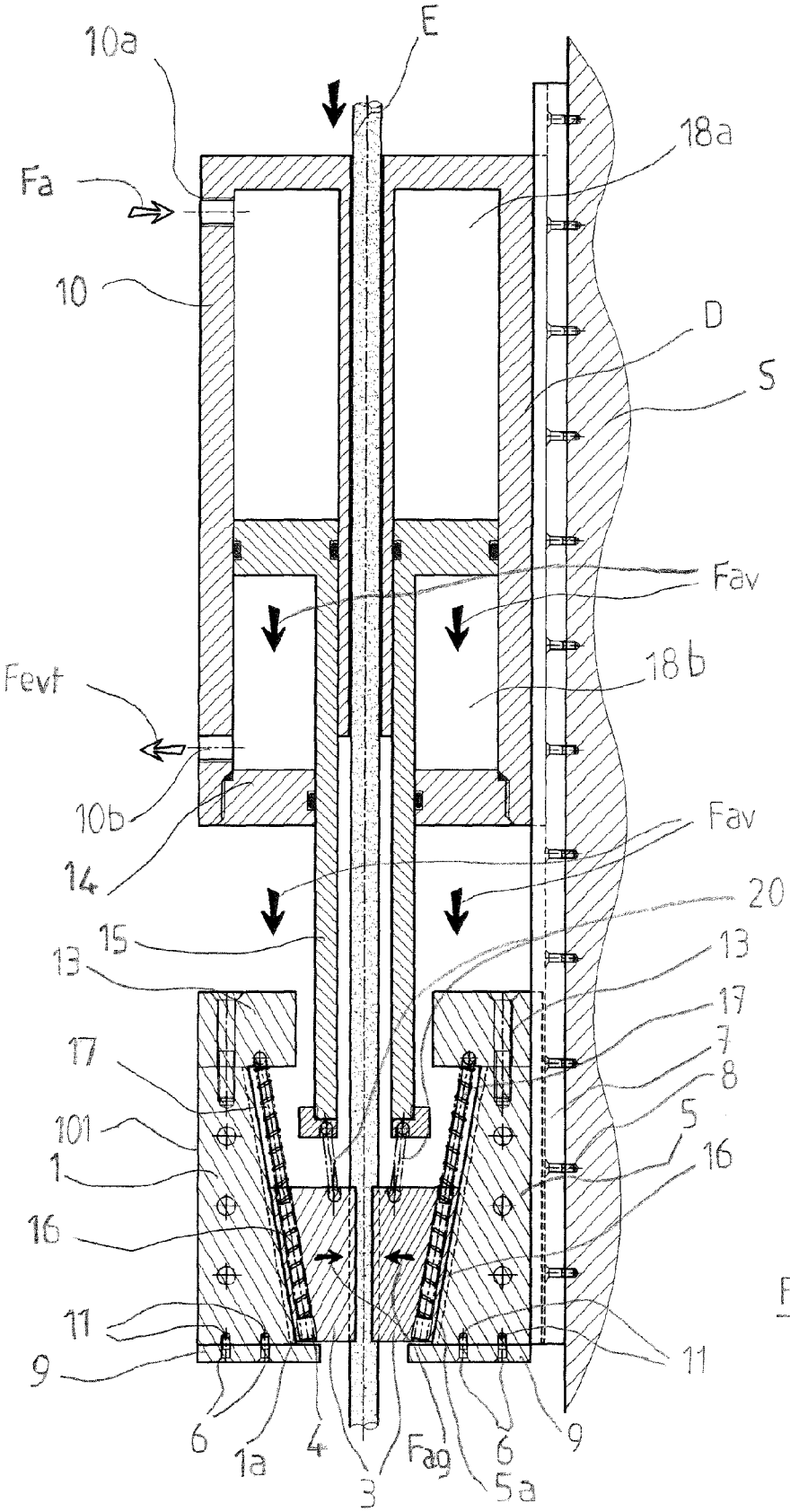
Figure 4:
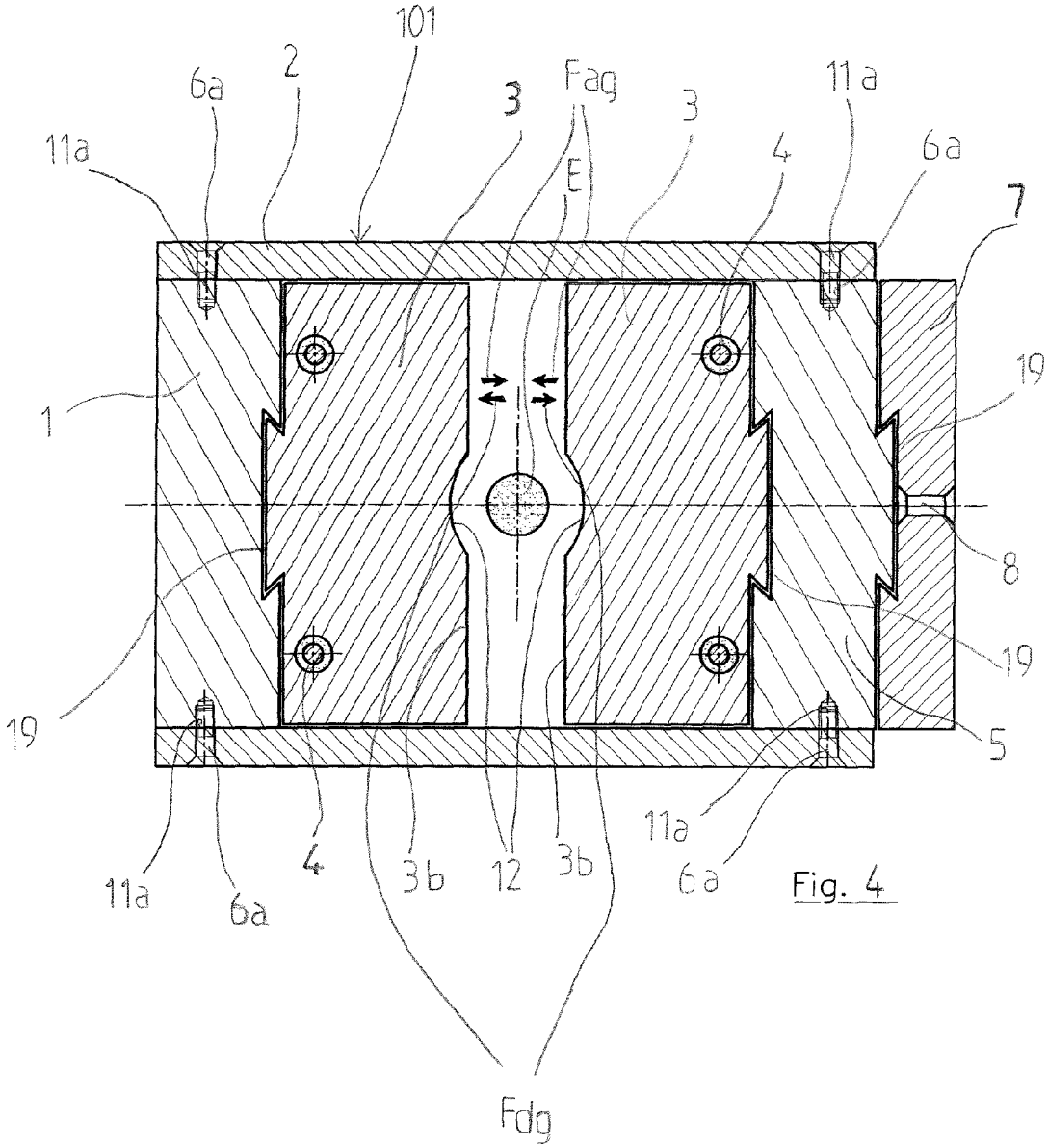

Other characteristics, goals and advantages of this invention will appear on reading the detailed description which follows and taking into consideration the appended drawings given as a non-restrictive example and on which:

FIG. 1 is a longitudinal section of the device for gripping and adjusting the tension of an elongated component as per the present invention, the said device being shown in a first position in which no gripping force is applied to the elongated component, FIG. 2 is a longitudinal section of the device for gripping and adjusting the tension of an elongated component as per the present invention, the said device being shown in a second position in which the gripping force alone is applied on the elongated component without any tensile force, FIG. 3 is a longitudinal section of the device for gripping and adjusting the tension of an elongated component as per the present invention, the said device being shown in a third position in which the tensile force is applied on the elongated component previously gripped so that tensioning can take place, FIG. 4 is a cross-section on A-A in FIG. 1 of the device for gripping and adjusting the tension of an elongated component as per the present invention, this figure showing a possible but not exclusive embodiment of the sliding and/or laterally retaining means between, on the one hand, gripping jaws and associated base and, on the other, one of the front assembly bases and a base for fixing to the support structure.

DETAILED DESCRIPTION

By referring to FIGS. 1 to 4, device D for gripping and adjusting the tension of an elongated component E as per the present invention is penetrated by the aforementioned elongated component E through its rear body 10 and is traversed longitudinally, roughly in its centre. This rear body 10 is extended by a mobile tightening front assembly 101 relative to rear body 10, elongated component E emerging from device D through the front of this front tightening assembly 101.

Without it being restrictive, FIGS. 1 to 3 propose means for actuating the jaws, shown in the form of a cylinder, the body of which forms rear body 10. This cylinder body is equipped with a cylinder rod 15 surrounding but without contact with elongated component E. When operating, rod 15 may project from body 10 at the front thereof and penetrate partially into front mobile tightening assembly 101 of device D, as shown on FIGS. 2 and 3.

Several cylinders may also be used instead of a single cylinder.

FIGS. 1 to 3 show a double-acting hydraulic cylinder actioning jaws 3 with two chambers 18*a* and 18*b*, each one with a feed or discharge port 10*a* or 10*b* with pressure applied alternately on each side of the head of cylinder rod 15, driving movement of rod 15 in two opposite directions in and out of cylinder body 10. Such a type of cylinder can also be associated with a servovalve or a distributor valve with proportional control, be supplied with compressed air or another incompressible fluid.

Obviously, other types of cylinder can be used, for example a single-acting cylinder executing both the inward and outward actions, the cylinder rod comprising a spring to bring it back to a position inside the cylinder, this also being possible by other external means. A gas-operated cylinder with an end-of-travel force greater than that of the spring-type cylinder or a telescopic-rod cylinder to increase the range of tension adjustment transmitted to the elongated component E can also be used as will be seen hereafter. In an alternative arrangement, at least one electrically operated cylinder of the screw jack type driven by an electric motor may also be used.

Front mobile tightening assembly 101 for gripping and tension adjusting device D consists of two sliding bases 1 and 5 around but without contact with elongated component E. This front tightening assembly 101 is mobile relative to rear body 10 of device D in the lengthwise direction of device D. For example, in FIG. 1, the front mobile tightening assembly 101 is in contact with front face 14 of rear body 10 of device D whereas on FIG. 3, this front mobile tightening assembly 101 is not in contact with rear body 10 after having slid towards the front of device D in the direction shown by arrows Fav.

As shown on FIGS. 1 and 3, device D for gripping and adjusting the tension of an elongated component E can be fastened to a support structure S. This is not necessarily the case but may be advantageous when used in or on a mobile structure, for instance a ship. On FIGS. 1 to 3, base 7 of front tightening assembly 101 and rear body 10 of device D is used, this base 7 having components for fixing on support structure S, only one of which is referenced 8, these components being positioned at regular intervals along base 7. Base 7 is also shown on FIG. 4, without this support structure being shown on this figure.

By reference to FIGS. 1 to 4, sliding base 5 of front tightening assembly 101 nearest to base 7 is called the lower sliding base plate whereas the other sliding base plate 1 is called the upper sliding base. As can be seen on FIG. 4 in particular, lower sliding base 5 is able to slide relative to base 7 to allow movement lengthwise away from or towards rear body 10 of device D. A possible and non-restrictive embodiment of the sliding means and/or lateral retaining means between lower sliding base 5 and base 7 will be described later relative to this FIG. 4.

In accordance with the present invention, device D performs gripping and tensioning of elongated element E consecutively. Device D makes it possible to change the tension of the component within a certain range without releasing its grip.

Gripping is carried out by jaws 3, positioning at least partially around elongated component E. Jaws 3 can also take the form of a single part in which case it takes the form of a bit. Advantageously, there are two jaws 3 that can be positioned symmetrically relative to the longitudinal axis of device D in order to act from opposite directions on elongated component E when it is tightened between said jaws 3 in order to uniformly distribute the gripping force around component E.

In FIG. 4, it can be seen that inner surface 3*b* of jaws 3 opposite elongated component E has an imprint 12 adapted to an elongated component E which may be a rope, a cable or a technical equivalent. On FIG. 4, imprint 12 has a rounded shape, although it may have another shape in order to grip an elongated component E with a specific shape.

On the one hand, these jaws 3 are arranged between sliding bases 1 and 5 of this front assembly 101 in the inner space left vacant between said bases 1 and 5 of this assembly 101, each jaw 3 being positioned between one of bases 1 or 5 and the elongated component E positioned centrally to front tightening assembly 101. As shown in FIG. 1, part 3*a* of jaws 3 presses on internal wall 1*a* or 5*a* respectively of base 1 or 5 so that jaws 3 are able to slide along the aforementioned internal wall. This internal wall 1*a* or 5*a* is part of a guiding system specific to a given jaw 3.

As shown on FIGS. 1 to 3, walls 1*a* or 5*a* of sliding base 1 or 5 form inclined ramps to bring them closer together the closer they are to the front end of the tightening assembly, and therefore the front of device D. It follows that jaws 3, when sliding towards the front of device D on internal wall 1*a* or 5*a* respectively forming a ramp, become closer one to the other and are able to grip elongated component E. Arrow Fag on FIGS. 1, 2 and 4 show jaws 3 coming together to grip elongated component E, whereas arrow Fdg on FIGS. 3 and 4 show jaws 3 moving apart to release elongated component E. These movements of coming together and moving apart take place when jaws 3 slide on internal walls 1*a* or 5*a* of sliding base 1 or 5, respectively towards the front or rear of device D.

In an alternative arrangement, an inclined internal wall on one sliding base plate alone may be envisaged, an embodiment that is not shown on the figures. In this case, only one jaw is brought closer to the other jaw, or other jaws when there are more than two, during the movement towards the front of the jaws, this movement taking place when the said jaw slides on the inner wail of the associated base.

Thus, there may be at least three embodiments, the first with two jaws, the second with an inclined wall on one base and the third guiding on the side closing plates.

In addition, as shown on FIGS. 1 to 3, the rear part of each jaw 3 is joined is to the front end of cylinder rod 15 by a component 20. Several cylinders may also be used, for example one cylinder for each jaw 3.

As jaws 3 can be brought closer together or moved apart, it is an advantage that joining components 20 have freedom of movement transversally to device D. Advantageously, each joining component 20 may take the form of coupling rod articulated around a pivot, on the one hand on the front end of cylinder rod 15 and on the other on the rear part of corresponding jaw 3.

As to the cylinder, as previously stipulated, this is advantageously double acting and has a first chamber 18*a* or cylinder head side chamber with intake or discharge port referenced 10*a* so that, when hydraulic fluid is taken into chamber 18*a*, pressure is created on the head of cylinder rod 15 and starts rod 15 moving out in the direction of the front of device D. It is to be noted that the head side of cylinder rod 15 can also be called the bottom side.

Body 10 of the cylinder also has a second chamber 18*b* or cylinder rod side chamber with an intake or discharge port referenced 10*b* so that, when there is an intake of hydraulic fluid into this chamber 18*b*, pressure is created on the side opposite to the head of cylinder rod 15 as previously and starts retraction of rod 15 towards the rear of device D.

When cylinder rod 15 is driven out of cylinder body 10, it pushes on jaws 3 which slide towards the front of device D, and vice versa when rod 15 is retracted inside body 10.

For each jaw 3, return means at least, for instance a spring 16 returning said jaw 3 towards the rear of device D in the position shown in FIG. 1 or alternatively a gas cylinder or a technical equivalent, are provided. This return spring 16 advantageously takes the form of a helicoidal spring, each jaw 3 advantageously comprising two springs, as shown in FIG. 4. Each return spring 16 expands in a cavity 4 arranged on a part of jaw 3, this cavity 4 being appreciably parallel to internal wall 1*a* or 5*a* forming a ramp for associated base 1 or 5. Return spring 16 may be associated with a retaining component 17, said spring 16 being wound around retaining component 17.

Each spring 16 has a first end fixed to a point on the associated sliding base 1 or 5 on the rear part of front assembly 101, advantageously on rear stop plate 13, which in a preferred arrangement is removable from its associated base 1 or 5. The same applies advantageously to its associated retaining component 17. Rear stop plate 13 is on and at the rear of associated base 1 or 5, and forms the part opposite the front face of cylinder body 10 through which rod 15 emerges from the cylinder. The other end of each spring 16 is advantageously secured to the most forward part of corresponding retaining component 17.

Jaws 3 on FIG. 1 are then arranged on the part of internal walls 1*a* or 5*a* of base 1 or 5 furthest towards the rear. The inclination and spacing between internal walls 1*a* and 5*a*, like the thickness of jaws 3, are predetermined so that aforementioned jaws 3 cannot then grip elongated component E. Each spring 16, associated on the one hand with a jaw 3 and on the other with a base 1 or 5, is not in a tensioned position while retaining component 17 remains inside its cavity 4 on jaw 3.

This position of device D corresponds is to a nil intake of hydraulic fluid through the intake port or discharge port 10*a* of rod head side chamber 18*a* of cylinder body 10, or results from the discharge of hydraulic fluid as symbolised by arrow Fe, a discharge that may be simultaneously combine with an intake of hydraulic fluid into chamber 18*b* of cylinder body 10 as shown by the arrow Fent. In this position in particular, elongated component E is free to move both towards the front or the rear of device D.

On FIG. 2, jaws 3 are on the most forward part of internal walls 1*a* or 5*a* forming ramps after sliding on them respectively. Jaws 3 have thus been brought closer one to the other by the inclination of internal was 1*a* and 5*a*, gripping elongated component E. Each spring 16 is extended able to return associated jaw 3 to the rest position when the return force of springs 16 exceeds the force exerted by cylinder rod 15 on jaws 3, for example as a result of lower intake of hydraulic fluid into chamber 18*a* on other rod head side of cylinder body 10 or on the discharge of fluid into this chamber 18*a* of body 10.

Part of spring retaining component 17 projects outside jaw 3 between the rear and rear stop plate 13 of corresponding base 1 or 5. This retaining component 17 then exerts a retaining force on the part of spring 16 emerging from associated jaw 3 by rendering the aforementioned part of spring 16 rigid.

This position of device D corresponds to an intake of hydraulic fluid through intake port or discharge port 10*a* of rod head side chamber 18*a* of cylinder body 10, as symbolised by arrow Fa. This intake of hydraulic fluid may be reinforced by a discharge of hydraulic fluid through intake or discharge port 10*b* of the other rod side chamber 18*b* of cylinder body 10, as shown by arrow Fevt.

In this position in particular, means for temporarily joining front tightening assembly 101 against front face 14 of body 10 of device D may be envisaged in order to prevent this mobile front assembly 101 from moving inadvertently towards the front, these means not being shown on the figures but able to be shown in the form of return springs. Thus, it is advantageous to envisage a safety system that avoids release of the elongated component by mistake.

As to FIG. 3, the position of device D differs from FIG. 2 mainly by it sliding towards the front of sliding bases 1 and 5 forming front mobile assembly 101 tightening device D.

In this position, jaws 3 apply sufficient force to grip elongated component E. Jaws 3 can no longer move forward front tightening assembly 101 towards the front of device D as they are stopped by front stop plate 9 associated with each base 1 or 5, this plate 9 being preferably removable from its associated base 1 or 5. Front stop plate 9 can be fixed on its specific base 1 or 5 by removable fixing means 6, for example a screw penetrating a tapped band hole 11, common to sliding base 1 or 5 and said front stop plate 9. In an advantageous arrangement, the same front stop plate 9 can be common to the two bases 1 and 5, joining these two bases 1 and 5 together.

Such a stop plate 9 is only one of the possible means for joining front assembly 101 and jaws 3. Such a plate 9 can be replaced by any means for joining front assembly 101 with jaws 3, it being understood that the said means have to be active after positioning so as to ensure elongated component E is gripped by said jaws 3 as shown on FIG. 2. Movement of the said jaws then also drives the said assembly towards the front which is then joined, the said assembly applying a forward tractive force to the elongated component.

When a force is always exerted on cylinder rod 15 in order to push it towards the front of device D in the direction of arrows Fav, jaws 3 can no longer move towards the front of front assembly 101 as they are stopped by butting against front retaining plate 9. All mobile front assembly 101 of tightening device D is moved forwards by the actuating means, for example a double-acting cylinder as shown on FIG. 3. There follows a tractive force applied to elongated component E which is joined to front tightening assembly 101 by prior gripping of component E by jaws 3, as shown on FIG. 2.

This tractive force on elongated component E tightens it. In this position, the cylinder, which is advantageously of the double-acting type, may be driven in one direction or another in order to adjust the tension applied to elongated component E without jaws 3 releasing their grip. This applies within a certain range of tension corresponding to the possible forward and backward movements of front tightening assembly 101, the movement of front tightening assembly 101 in the direction of tensioning the elongated component being limited by the length of rod 15 and the displacement of the assembly in the direction of tension relaxation is limited by front tightening assembly 101 butting against front face 14 of body 10 of the cylinder. As previously mentioned, the use of a telescopic cylinder rod can in certain cases prove to be useful, although this is not essential.

When a gripping and tension adjusting device D is fixed on a support structure, as shown on FIGS. 1 to 4, and with lower sliding base 5 of front tightening assembly 101 supported by base 7, this lower base 5 is capable of sliding relative to base 7 which remains fixed, being joined to support structure S.

Conversely, and not shown on the figures, when the device is not tied to a support structure, means may be provided for limiting the freedom of movement of the front assembly relative to the rear body of the device so that this movement only takes place longitudinally to the device. These means may take the form of at least one sliding bar, although preferably at least two bars will be used, on the rear part of the front tightening assembly and extending lengthwise towards its rear body, the said rear body comprising a housing adapted to the aforementioned bar in which the bar is able to slide with limited transversal play. Thus, the only authorised movement of the front assembly relative to the rear body is a movement of the device lengthwise.

FIG. 4 shows a cross-section A-A on FIG. 1 of front assembly 101 of device D for gripping and adjusting the tension of an elongated component E. This figure shows an embodiment of the sliding movement between on the one hand, jaws 3 relative to associated sliding bases 1 and 5 and on the other, lower sliding base 5 relative to base 7 fixing to the support structure. These various sliding motions are made possible by the presence of sliding means and/or specific lateral means limiting each sliding motion, the aforementioned means being shown as a dovetailed coupling 19 between the above-mentioned components.

It has to be borne in mind that this arrangement is not limiting and that other means for improving the sliding motion and/or guaranteeing limit on a lateral sliding motion can be applied, for example sliding on rails, balls, a slide plate or a solid film of lubricant, for example an appropriate plastic or liquid lubricant when a minimum seal between the various components has to be guaranteed.

FIG. 4 also shows mobile front tightening assembly 101, formed mainly of bases 1 and 5, with a side cover plate 2 on each one of its sides covering the aforementioned sides at least partially. Each cover plate 2 is joined removably to one of sliding bases 1 and 5 by removable fixing means 6*a*, for instance a screw penetrating a tapped blind hole 11*a* common to sliding bases 1 and 5 and to associated side cover plate 2.

A safety device may be used to prevent inadvertently releasing the elongated component when front tightening assembly 101 is in contact with the front face of the cylinder. Similarly, a safety device may be envisaged to prevent to front mobile tightening assembly 101 leaving the front face of the cylinder before jaws 3 butt against front stop plate 9.

The present invention can apply in all fields where it is necessary to grip an elongated component, whether metal or any other material, this component having a more or less large section to which tension is to be applied. For example it may be used with a winch, such as a hydraulic winch.

A particularly interesting but non-exclusive application of the device for gripping and adjusting the tension of an elongated component is its association with a ship forming the support structure, for example a sail boat. This device is then useful mainly as equipment for fastening, securing and adjusting running and standing rigging and other movements. In particular, it can be used to block and adjust the tension of halyards on jibs, foresails, or other sails, foresheet turning gear, main sails or any other sails by allowing accurate and forceful adjustment. Similarly, the device enables rapid and full release when required of foresheets, jibs, main sails, and any other type of sail. As a temporary fitting on all jibs, foresheets or other manoeuvres, it can be used to release a cleat, pulley or winch, while maintaining the sail correctly set by its halyard and/or foresheet. On standing rigging, for instance backstay volant, shroud flying, after taking up all the slack, the device allows powerful and precise end-of-travel adjustment.

Such a device can also be used on land, especially if required to attach, secure and adjust the tightness of a fabric or a sailcloth.

REFERENCES

1. Upper sliding base
1*a*. Internal wall forming a ramp of the upper sliding base
2. Side closure plate
3. Jaw
3*a*. Part of a jaw executing a sliding motion
3*b*. Inner surface of a jaw opposite elongated component
4. Return spring housing cavity and retaining component in a jaw
5. Lower sliding base
5*a*. Inner wall forming ramp for the lower sliding base
6. Screw fastening the front stop plate
6*a*. Screw fastening side closure plate
7. Base fixing rear body and front tightening assembly to a support structure
8. Screw fastening fixing the base to support structure
9. Front stop plate for tightening assembly
10. Device rear body
10*a*. Intake or discharge port in rod head side of cylinder body
10*b*. Intake or discharge port in rod side of cylinder body
11. Tapped blind hole for screw fastening front stop plate
11*a*. Tapped blind hole for screw fastening side closure plate
12. Imprint on the face of a jaw opposite elongated component
13. Rear stop plate of tightening assembly
14. Front face of the cylinder body
15. Cylinder rod
16. Return spring
17. Return spring retaining component
18*a*. Rod head internal chamber of the cylinder body
18*b*. Rod internal chamber of cylinder body
19. Sliding and/or lateral retaining means
20. Component joining cylinder rod and jaws
101. Front mobile tightening assembly
D Gripping and tension adjusting device
E Elongated component
S Support structure
Fa Arrow showing fluid intake, rod head side of cylinder body
Fag Arrow showing movement of jaws in the direction of elongated component gripping
Fav Arrow showing movement of the cylinder rod in the direction of elongated component gripping
Fdg Arrow showing movement of the jaws in the direction of elongated component release
Fe Arrow showing fluid discharge, rod head side of cylinder body
Fent Arrow showing fluid discharge, rod side of cylinder body
Fevt Arrow showing fluid discharge, rod side of cylinder body

What is claimed is:

1. Device for gripping and adjusting the tension of an elongated component, said device being penetrated longitudinally in its middle part by said elongated component and comprising lengthwise a rear body, through which said component is inserted into device, and extended by a front tightening assembly, allowing the said component to emerge from device and applying force transversally on said elongated component through jaws positioned around, at least partially, said component and arranged inside said front assembly, said jaws being longitudinally mobile inside said front assembly under the action of at least one actuating means, said front assembly having at least a one-jaw guiding system in order to move together jaws closer together in order to grip said component inside said assembly, the distance between jaws decreasing as they move towards the front, characterised in that front tightening assembly is mobile relative to rear body and includes at least one means for joining it with jaws, such means becoming active after said jaws are placed in a gripping position, movement of said jaws driving the movement of said joined assembly which then applies a tractive force towards the front of elongated component.

2. Device according to claim 1, characterised in that joining means consists of a stop in the front part of front assembly preventing forward movement of jaws relative to said assembly.

3. Device according to claim 2, characterised in that the stop takes the form of a stop plate removably placed in the front part of the front tightening assembly.

4. Device according to claim 1, characterised in that front tightening assembly comprises two bases positioned symmetrically relative to its longitudinal axis, each one of bases being associated with a jaw and at least one base and having an internal wall forming a ramp so that a jaw slides due to it being inclined towards the longitudinal axis of front assembly in the direction of said assembly, said internal wall (1*a* or 5*a*) being part of jaw guiding system (1*a*, 5*a*, 19),

5. Device according to claim 1, characterised in that guiding system (1*a*, 5*a*, 19), has sliding means and/or lateral retaining means in the form of a dovetail, a rail or a track coacting with bearing rollers or balls, a solid film or a liquid lubricant,

6. Device according to claim 1, characterised in that return means are provided between each jaw and rear part of front tightening assembly, the first end of the return means enacting with said rear part and the second end being joined on jaw, return means returning their associated jaw towards the rear and therefore to a position that releases elongated component from jaws.

7. Device according to claim 5, characterised in that each jaw has at least one cavity receiving at least partially said return means in the form of a helicoidal spring, this cavity extending roughly parallel to inner wall of associated base, second end of spring being joined to the bottom of cavity, a retaining component being positioned inside spring, one end of this retaining component being joined to the rear part of front assembly in common with the first end of the spring.

8. Device according to claim 1, characterised in that the actuating means consist in at least one cylinder, the cylinder body forming the rear body of device and cylinder rod being connected to the rear part of at least one jaw.

9. Device according to claim 8, characterised in that the cylinder is a double-acting cylinder comprising a first chamber with a hydraulic fluid intake or discharge port, intake of fluid into this chamber driving rod out of cylinder body and a second chamber with an intake or discharge port, the intake of fluid into this chamber driving retraction of rod inside cylinder body.

10. Device according to claim 8, characterised in that a coupling rod couples cylinder rod to at least one jaw, this coupling rod being articulated respectively with cylinder rod and said jaw.

11. Device according to claim 8, characterised in that a single cylinder actuates jaws.

12. Device according to claim 1, characterised in that it is designed to receive an elongated component such as a rope, cable or similar, each internal surface of jaws in contact with this elongated component having an imprint adapted to the elongated component in order to coact with said component when gripping it.

13. Support structure characterised in that it supports a device for gripping and adjusting the tension of an elongated component according to any one of the above claims, said device being fastened to support structure by a fixing base, front tightening assembly of said device having freedom to slide longitudinally relative to base to device, a means for sliding and/or lateral retention being provided between front assembly and base.

14. Support structure according to claim 13, characterised in that it is a ship, elongated element being a rope of an item of equipment present on said ship.

* * * * *